US007383175B2

(12) United States Patent
Doran et al.

(10) Patent No.: US 7,383,175 B2
(45) Date of Patent: Jun. 3, 2008

(54) PITCH ADAPTIVE EQUALIZATION FOR IMPROVED AUDIO

(75) Inventors: Patrick J. Doran, Plantation, FL (US); Stephen S. Shiao, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 617 days.

(21) Appl. No.: 10/397,033

(22) Filed: Mar. 25, 2003

(65) Prior Publication Data

US 2004/0193405 A1 Sep. 30, 2004

(51) Int. Cl.
*G10L 11/04* (2006.01)
*G10L 21/00* (2006.01)
*G10L 21/02* (2006.01)

(52) U.S. Cl. ..... 704/207; 704/225; 704/228

(58) Field of Classification Search ..... 704/207, 704/225, 228
See application file for complete search history.

(56) References Cited

U.S. PATENT DOCUMENTS 5,323,422 A * 6/1994 Ushirokawa ..... 375/232
5,400,362 A * 3/1995 Chennakeshu et al. ..... 375/285
5,920,834 A * 7/1999 Sih et al. ..... 704/233
6,724,706 B1 * 4/2004 Nakajima et al. ..... 369/59.23
6,735,375 B1 * 5/2004 Ogasawara et al. ..... 386/46

* cited by examiner

*Primary Examiner*—David Hudspeth
*Assistant Examiner*—Justin W. Rider
(74) *Attorney, Agent, or Firm*—Scott M. Garrett

(57) ABSTRACT

A pitch adaptive circuit (200) includes an equalizer control circuit (206) that evaluates the pitch of the speech signals that are being processed and depending on the pitch information, the equalizer control circuit (206) selects an equalizer (208, 210) to shape the decoded speech signals. By selecting the best equalizer (208 or 210) to use based on the pitch information, improvements in audio quality are provided automatically without user intervention.

14 Claims, 2 Drawing Sheets

PITCH ADAPTIVE EQUALIZATION FOR IMPROVED AUDIO

TECHNICAL FIELD

This invention relates in general to the field of electronics, more specifically to a method and apparatus for providing pitch adaptive equalization for improved audio.

BACKGROUND

Communication devices such as digital cellular telephones use low bit rate vocoders to encode and decode the users' speech signals. Modeling and compressing of the speech signals achieves increased capacity in a communication system. The end product of modeling and compressing of the speech signals is sometimes unnatural sounding reproduced speech. Added to this problem is the constant pressure to keep manufacturing costs low in electronic devices, which leads to the use of lower quality audio circuitry, microphones, speakers, etc.

Equalization of the audio signal, which can be done either in hardware and/or software, can help increase the intelligibility of the decoded speech and counteract some of the limitations of the audio circuitry. However, the problem with equalization is that it is very difficult to provide equalization for a broad group of users such as female and male voices.

In FIG. 1, there is shown a prior art audio circuit having an equalizer. Coded speech is presented to a vocoder 102 that provides decoded speech at its output. The decoded speech is sent to an audio equalizer 104 for equalization prior to being converted to analog by digital-to-analog converter 106. The analog speech is then presented to a speaker (or earpiece) 108. Although useful, the equalizer 104 can not provided optimum equalization for speech signals having different pitch. An equalization curve that may provide good results for higher pitched voices may leave lower pitched voices sounding muffled. While an equalization setting that may sound good for lower pitched voices may leave higher pitched voices sounding harsh or thin.

One solution to the equalization problem above is to provide simple "bass" and "treble" controls that the user can adjust manually or by providing a multi-band equalizer as found in some audio equipment. However, such controls are not typically found in cellular telephones and even if they were, the cellular telephone user may do more harm than good, since proper equalization setting can be tricky. Users may end up blaming poor sound quality on the cellular telephone and associate poor sound quality with the particular cellular telephone manufacturer even if the poor sound quality is caused by improper equalizer settings. A need thus exists in the art for a better method of providing different equalization setting for different voice types in order to improve the overall sound quality in communication devices such as cellular telephones.

BRIEF DESCRIPTION OF THE DRAWINGS

The features of the present invention, which are believed to be novel, are set forth with particularity in the appended claims. The invention, may best be understood by reference to the following description, taken in conjunction with the accompanying drawings, in the several figures of which like reference numerals identify like elements, and in which:

DETAILED DESCRIPTION OF THE PREFERRED EMBODIMENT

Figure 1:
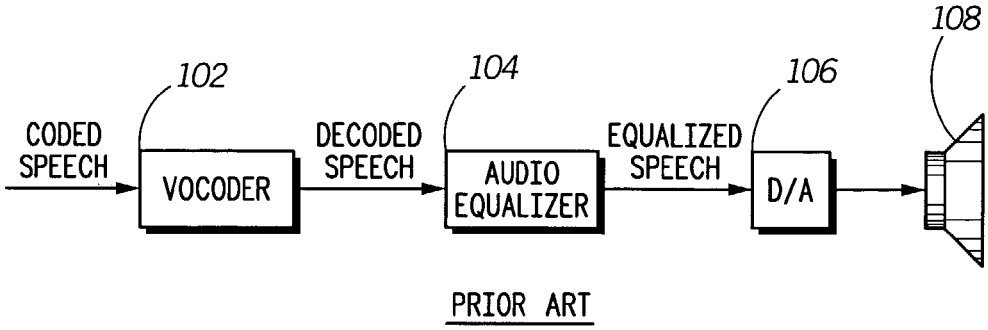
FIG. 1 shows a prior art equalization technique.

While the specification concludes with claims defining the features of the invention that are regarded as novel, it is believed that the invention will be better understood from a consideration of the following description in conjunction with the drawing figures.

Figure 2:
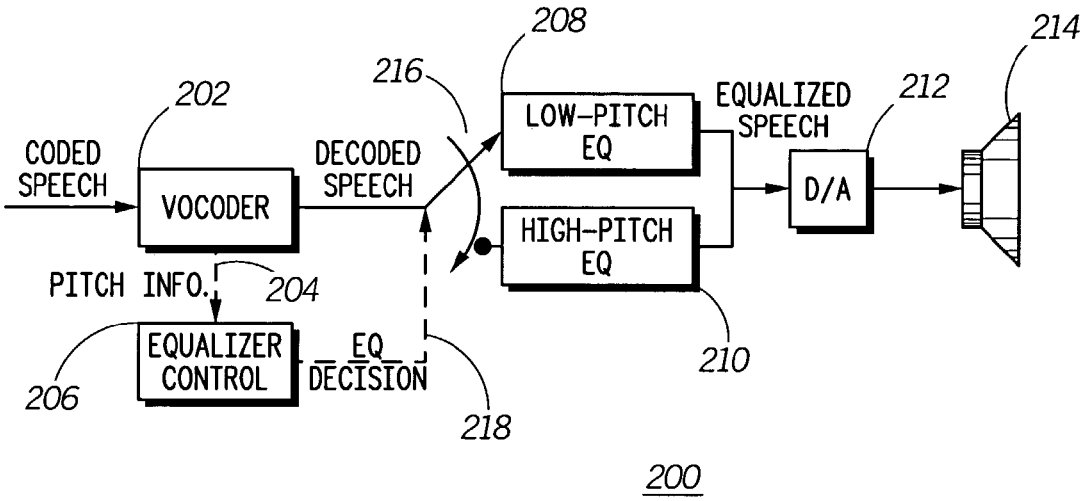
FIG. 2 shows a block diagram of a pitch adaptive equalization circuit in accordance with the invention.

Referring now to FIG. 2, there is shown a pitch adaptive equalization circuit 200 in accordance with one embodiment of the invention. Coded speech is provided to an input port of a vocoder 202 for decoding of the speech. In this embodiment it is assumed that vocoder 202 provides pitch information 204 such as an estimate of the pitch of the speech it is decoding. The pitch information 204 is provided to an equalizer control circuit 206. Equalizer control circuit 206 can be for example a simple threshold circuit where pitch information below a certain frequency result in a first state such as a "low pitch" decision being made, while pitches above the certain frequency result in a second state such as a "high pitch" decision being made. A more sophisticated equalizer control circuit 206 may average the pitch estimates received from vocoder 202 over a predetermined period of time in order to prevent a possible scenario where the equalizer control circuit 206 based on the received pitch information 204 starts toggling between the "low pitch" decision and the "high pitch" decision. In still another design of equalizer control circuit 206, the equalizer control circuit 206 could support several threshold levels and the equalizer control circuit 206 could select from amongst more than two equalizer circuits.

The equalizer control circuit 206 based on the pitch determination the circuit has made provides a control signal 218. In the embodiment shown, the control signal 218 controls a switch 216 that selects between a first or low-pitch equalization circuit 208 or a second or high-pitch equalization circuit 210. Although, two equalization circuits are shown, in other designs more than two equalization circuits can be supported with the equalizer control circuit 206 providing the extra control signal information to make the equalization decision. The equalization circuits 208, 210 shape the decoded speech signal provided by the vocoder 202 and is each set to equalize for a different pitched signal. The equalization circuits or equalizers 208, 210 can be formed from just hardware or just software or a combination of both. In the case the equalizers 208, 210 are formed using software, switch 216 represents the selection of the appropriate equalizer software routine or equalizer coefficients from memory.

After equalization, the equalized speech is converted into analog by a digital-to-analog (D/A) converter 212. The analog signal is then presented to a speaker or earpiece 214. Although not shown, typically an audio amplifier is provided to amplify the analog speech signal prior to being presented to speaker or earpiece 214.

Figure 3:
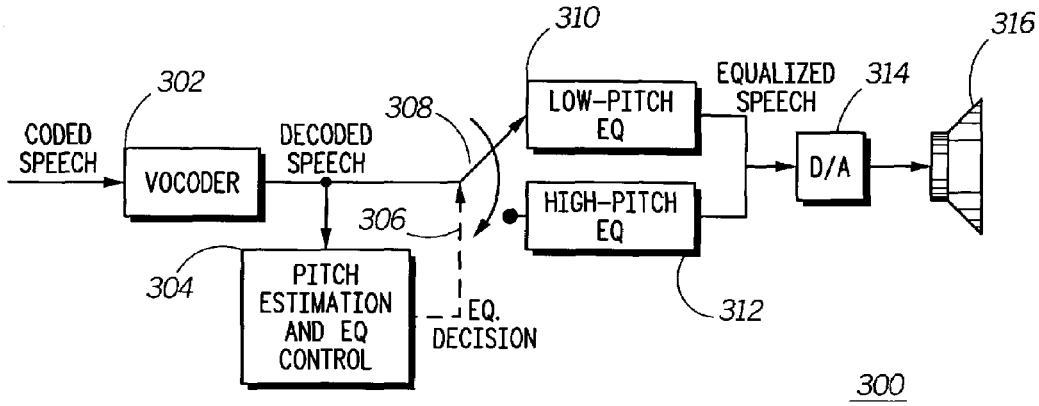
FIG. 3 shows a block diagram of an alternate embodiment of a pitch adaptive equalization circuit in accordance with the invention.
Figure 4:
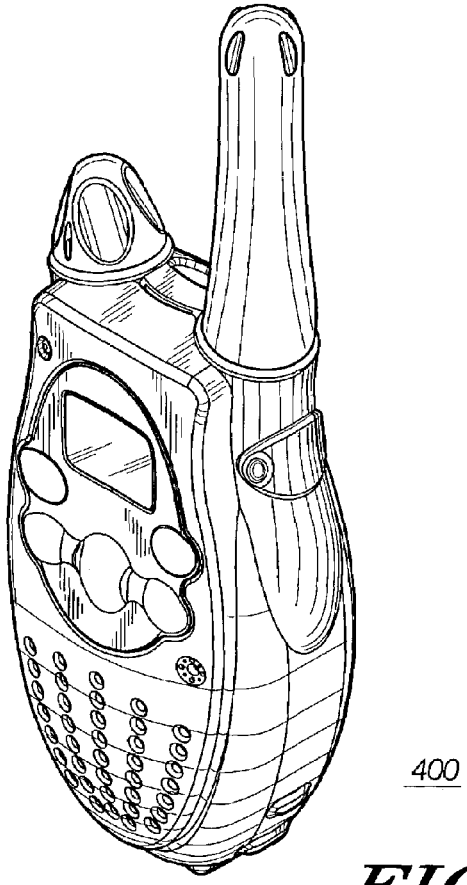
FIG. 4 shows an electronic device such as a cellular telephone in accordance with the invention.

In FIG. 3 there is shown another embodiment of a pitch adaptive equalization circuit 300, in circuit 300 the vocoder 302 does not provide a pitch estimate as in circuit 200, so a pitch detection/estimation and equalization control circuit 304 is provided. Circuit 304 can use one of a number of well-known pitch detection methods known in the art and again based on its pitch detection/estimation an equalization control signal 306 is provided to control switch 308. Switch 308 selects from amongst a first or low-pitch equalization circuit 310 or a second or high-pitch equalization circuit 312. Again, although two equalization circuits are shown, any number of equalizers can be used, depending on the design. If more than two equalization circuits are used, pitch detection/estimation circuit 312 can have as many pitch threshold circuits, as there are equalization circuits. After the appropriate equalization circuit 310 or 312 provides the proper shaping, the equalized speech is converted into analog by D/A circuit 314 prior to being presented to speaker 316. Again, equalizers 310 and 312 can be formed from hardware circuitry, software, or a combination of the two. In FIG. 4, there is shown a electronic device such as a cellular telephone 400 that uses a audio circuit having an adaptive equalization circuit such as circuit 200 or 300.

By adapting the audio equalization to the voice characteristics of the received speech signal, improvements in audio quality and intelligibility can be provided by the automatic equalization technique provided by the present invention. Selecting an equalization circuit based on the estimated pitch of the speech signal that is being equalized, helps provide better audio performance in electronic devices such as cellular telephones, etc.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A pitch adaptive equalization circuit, comprising:

a vocoder for receiving a coded speech signal and providing a decoded speech signal from the coded speech signal, the decoded speech signal having a pitch;

an input port coupled to the vocoder for receiving the decoded speech signal;

at least two equalizers; and an equalizer control circuit coupled to the input port, the equalizer circuit evaluates the pitch of the decoded speech signal and based on the evaluation provides a control signal that selects one of the at least two equalizers for use in equalizing the decoded speech signal.

2. A pitch adaptive equalization circuit as defined in claim 1, wherein each of the at least two equalizers have a different equalization setting.

3. A pitch adaptive equalization circuit as defined in claim 1, wherein the vocoder provides pitch information to the equalizer control circuit.

4. A pitch adaptive equalization circuit as defined in claim 1, wherein the equalizer control circuit includes a threshold circuit for determining which of the at least two equalizers to select using the control signal.

5. A pitch adaptive equalization circuit as defined in claim 1, wherein one of the at least two equalizers equalizes decoded speech signals having pitch information below a predetermined threshold level and another of the at least two equalizers equalizes decoded speech signals having pitch information above the predetermined threshold level.

6. A pitch adaptive equalization circuit as defined in claim 1, wherein the equalizer control circuit averages the pitch information provided by the vocoder prior to providing the control signal.

7. A pitch adaptive equalization circuit as defined in claim 1, wherein the equalizer control circuit determines the pitch of the decoded speech signal.

8. A pitch adaptive equalization circuit as defined in claim 1, wherein the at least two equalizers comprise either hardware or software or a combination of the two.

9. A method for providing equalization to a speech signal in an electronic device, comprising the steps of:

receiving a coded speech signal at the electronic device;

decoding the coded signal via a vocoder to provide a decoded speech signal, the decoded speech signal having a pitch;

determining the pitch of the decoded speech signal; and selecting an equalizer automatically from amongst a plurality of equalizers for equalizing the decoded speech signal based on the pitch of the decoded speech signal.

10. A method as defined in claim 9, wherein selecting the equalizer comprises:

evaluating the pitch of the decoded speech signal against a predetermined threshold; and generating a control signal in response to the evaluating.

11. A method as defined in claim 10, wherein the control signal controls a switch that selects the equalizer.

12. A method as defined in claim 9, wherein the electronic device comprises a cellular telephone.

13. A method as defined in claim 9, wherein determining the pitch is performed by a pitch estimation and equalizer control circuit.

14. A method as defined in claim 9, wherein the plurality of equalizers are comprised of hardware, software or a combination of hardware and software.

* * * * *